United States Patent [19]

Sipos

[11] 4,139,333

[45] Feb. 13, 1979

[54] POSITIVE DISPLACEMENT FLOW THROUGH FLUID PUMP

[75] Inventor: Laszlo Sipos, Saratoga, Calif.

[73] Assignee: GCA Corporation, Sunnyvale, Calif.

[21] Appl. No.: 798,024

[22] Filed: May 18, 1977

[51] Int. Cl.[2] ..... F04B 21/00; F04B 39/00; F04B 43/08; F04B 15/00

[52] U.S. Cl. ..... 417/63; 417/472; 417/430

[58] Field of Search ..... 92/13.2, 42, 43; 417/430, 63, 434, 435, 412, 472, 473, 567, 398–403

[56] References Cited

U.S. PATENT DOCUMENTS

| | | | |
|---|---|---|---|
| 1,546,973 | 7/1925 | Ellis | 92/42 |
| 1,557,878 | 10/1925 | Reeves | 417/567 |
| 1,580,479 | 4/1926 | Frankenfield | 417/473 |
| 1,793,513 | 2/1931 | Schneider | 417/567 |
| 2,231,861 | 2/1941 | Adams | 417/430 |
| 2,840,004 | 6/1958 | Guenther et al. | 417/394 |
| 2,960,038 | 11/1960 | Lupper et al. | 92/13.2 |
| 2,978,149 | 4/1961 | Rosen | 417/567 |

FOREIGN PATENT DOCUMENTS

| | | | |
|---|---|---|---|
| 1199667 | 12/1959 | France | 417/472 |
| 1377945 | 9/1964 | France | 417/472 |

*Primary Examiner*—William L. Freeh
*Attorney, Agent, or Firm*—Flehr, Hohbach, Test, Albritton & Herbert

[57] ABSTRACT

A positive displacement flow through fluid pump especially useful for dispensing exact volumes of photoresist on a silicon wafer uses a bellows for the main pumping component. The bellows is capped at both ends and they include slugs which extend into the interior of the bellows to minimize the static volume. In addition, internal porting is provided in the slugs to effectively wash or purge the convolutions of the bellows which results in continuous cleaning.

7 Claims, 5 Drawing Figures

FIG-1A
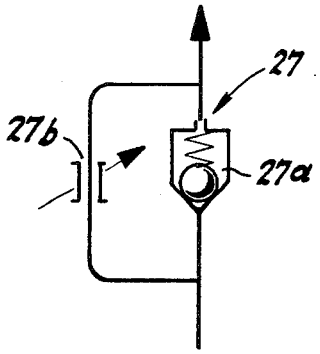
FIG-3
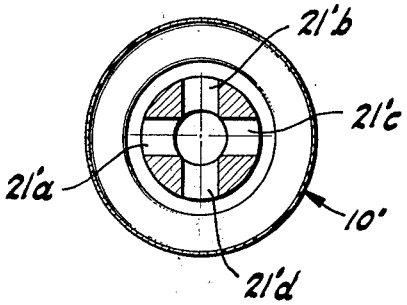
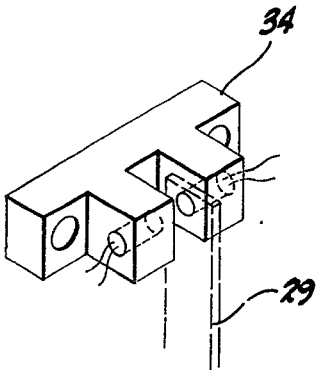
FIG-1B
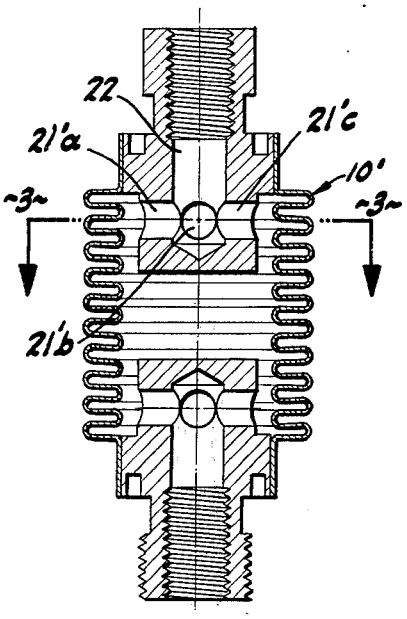
FIG-2

POSITIVE DISPLACEMENT FLOW THROUGH FLUID PUMP

BACKGROUND OF THE INVENTION

The present invention is directed to a positive displacement flow through fluid pump and more specifically to a pump especially adapted for photoresist where exact volumes must be dispensed.

Reciprocating bellow type pumps of the nonflow through type have been used for several years. These pumps have a single input/output port on the top of the bellows which is used for dispensing accurate volumes of, for example, photoresist liquid onto silicon wafers. Their disadvantages are a large stagnant volume which must periodically be flushed, the necessity for priming before initial operation and the difficulty of switching from one type of liquid to another without extensive cleaning, etc.

A type of flow through pump has been in use by at least two manufacturers which while eliminating a stagnant volume still has a large static volume of liquid in the pump. And since photoresist fluid is relatively expensive this large amount of static volume is expensive when changing fluids. In addition, these pumps still have the same difficulty as a nonflow through bellows type pump where the convolutions of the bellows have deposited on them the liquid which is being pumped which can only be removed by time consuming cleaning.

Yet another difficulty in both the foregoing types of pumps is that the bellows type structure on the output displacement stroke could be overstressed by too great an upstroke.

OBJECTS AND SUMMARY OF THE INVENTION

It is, therefore, an object of the present invention to provide an improved positive displacement flow through fluid pump obviating the above disadvantages.

In accordance with the above object there is provided a positive displacement flow through fluid pump which comprises a substantially cylindrical bellows having caps at both ends and at least one cap including a plug extending and displacing a substantial volume within the cylindrical bellows. The caps have inlet and outlet ports for the fluid to be pumped and means for reciprocating the bellows for dispensing exact volumes of the fluid.

BRIEF DESCRIPTION OF THE DRAWINGS

FIG. 1A is a fluidic diagram of a portion of FIG. 1;

FIG. 1B is a perspective view of an electro-optical portion of FIG. 1;

FIG. 2 is a cross-sectional view of an alternate embodiment of a portion of FIG. 1;

FIG. 3 is a simplified cross-sectional view taken along line 3—3 of FIG. 2 which is also applicable to a similar portion of FIG. 1.

DETAILED DESCRIPTION OF THE PREFERRED EMBODIMENTS

Figure 1:
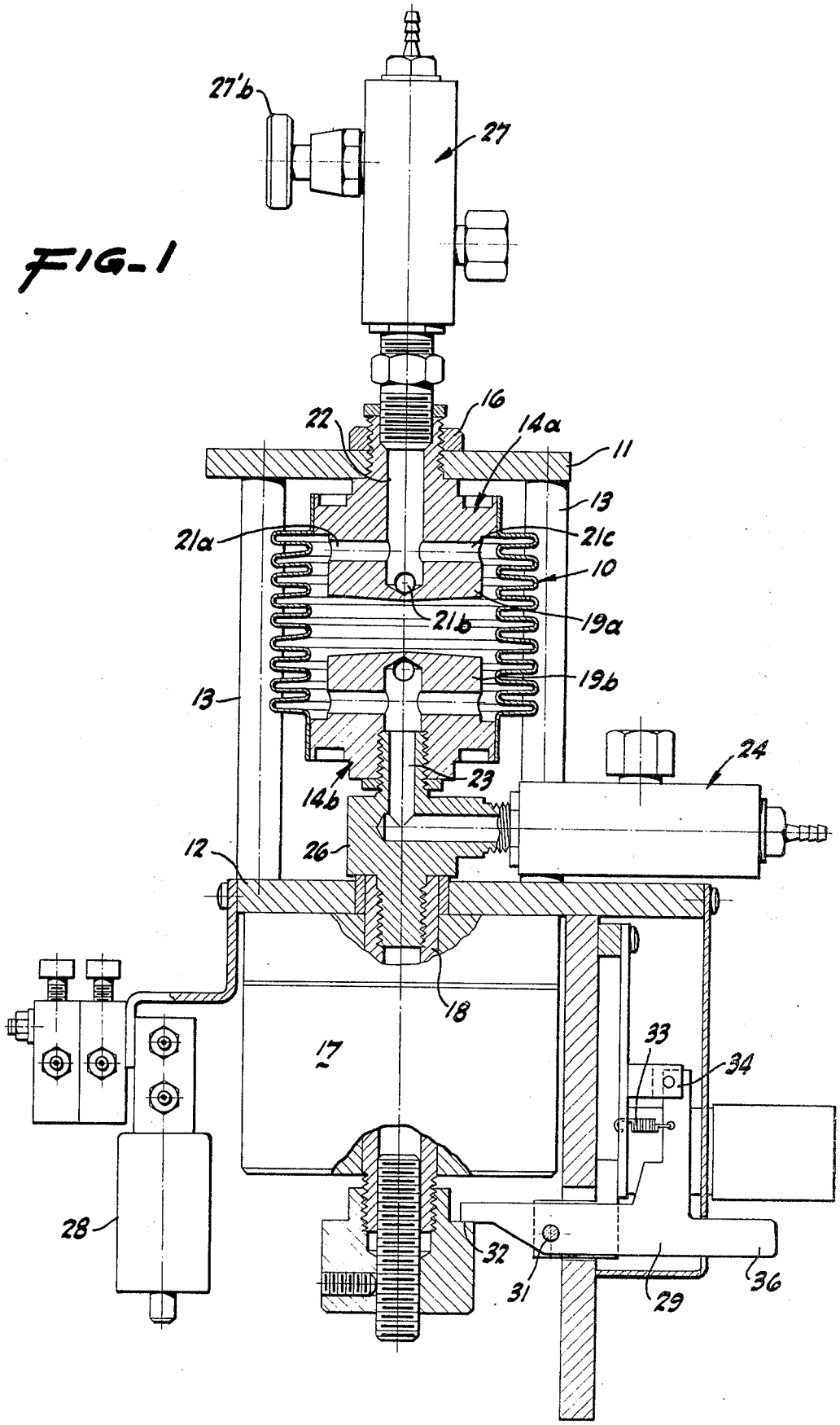
FIG. 1 is a simplified cross-sectional view of a flow through pump incorporating the present invention.

FIG. 1 is a cross-sectional view of the overall flow through displacement pump. A critical operating part in the pump is a cylindrical metal bellows 10. It is suspended between fixed parallel plates 11 and 12 which in combination with the four support posts 13 form the basic structural support for the pump. The upper end of bellows 10 is closed by a cap **14*a* which is welded to form an air tight seal between the cap and the bellows. Cap 14*a* is permanently fixed to top plate 11 by a lock nut 16. The lower end of bellows 10 is closed by a lower cap 14*b*** which, however, is movable to allow reciprocation of the bellows for dispensing exact volumes of the fluid.

This is accomplished by the air cylinder 17 which drives a piston rod generally shown at 18. Rod 18 is slidably mounted through bottom plate 12 to allow the entire bottom cap assembly 14 to be reciprocated.

In accordance with the invention each cap **14*a, b* includes a plug 19*a,b* extending into the cylindrical volume defined by bellows 10 the plug displacing a substantial volume within the bellows. This is to eliminate any static liquid volume. At the same time the juxtaposed faces of the plugs 19*a,b* limit reciprocating movement of the bellows when the faces make contact so that bellows 10** is not overstressed.

Each cap **14*a,b* has inlet and output ports to allow the flow through of the liquid; for cap 14*a* there are four inlet ports 21*a–d* which are arranged around the periphery of the cap as better shown in FIG. 3. In other words, the inlet ports are the ends of flow channels 21*a,c* and 21*b,d* displaced 90° from one another. These all converge at the outlet port 22. At least the ports 21*a* and 21*c* are located substantially opposite the extreme convolutions at the upper end of bellows 10 to provide a purging action or cleaning action when the fluid flows out of the bellows into outlet port 22. In addition, the flow channel construction illustrated in FIG. 1 is such that the 21*a, c* flow channel is offset, in the axial direction of bellows 10, from the 21*b,d* flow channel. This can be done where the volumetric capacity inside the bellows 10 is enough to allow the plug to be a sufficient depth. For example, the pump of FIG. 1** is used to dispense 15cc of liquid.

In contrast, the partial pump shown in FIG. 2 is used to dispense 4cc of liquid and therefore has a smaller bellows 10' where the two 90° displaced channels are not offset. They are in line as illustrated. In other words, channel **21'*a,c* is in line with channel 21'*b,d*.**

The spacing of the inlet ports, for example, **21*a*** from the convolutions is not critical but in practice it is 1/16 inch.

Identical channels and ports are present on the cap **14*b*. There, of course, the port 23 is an inlet port. This port is coupled to a check valve 24 which functions to allow only fluid to flow inwardly to the inlet port by the L-shaped connector 26 which is driven by pump piston 18**. Thus the entire check valve, elbow, and cap assembly reciprocates.

The outlet portion 22 of the pump is connected to a check valve and alternate bypass unit 27 which is available as a one piece unit as a standard off-the-shelf item. Its function is shown in FIG. 1A where in one parallel channel it includes a check valve **27*a* allowing only flow in the output direction where the fluid is dispensed, for example, upon a silicon wafer and a parallel channel 27*b* which is variable and allows enough backflow on the downstroke of the pump to "suck back" a portion of the liquid so no accidental drops will fall on the wafer. The adjustable control for the alternate bypass 27*b* is shown by the knob 27'*b* in FIG. 1**.

An appropriate solenoid 28 actuates air cylinder 17 for the upstroke and downstroke. Stroke monitoring is provided by a lever 29 which is pivoted at 31 and has one end riding on a shoulder 32 which is affixed to movable piston rod 18. On the upstroke the lever is rotated at pivot point 31 against the tension provided by spring 33 and actuates the LED (light emitting diode) switch 34. Such switch is shown in greater detail in FIG. 1B. Closure of switch 34 indicates a stroke completion and causes the solenoid 28 to provide a return stroke. Moreover, for purposes of priming or allowing manual operation of the pump for any reason, the lever extension 36 may be manually actuated to cause another stroke by rotating the lever to simulate a stroke completion.

In operation the pump of the present invention has several advantages over prior practices. Because of its flow through nature it is self-priming; in other words, no cap need be removed and liquid added to start its operation. There is no large dead liquid volume in the core of the bellows because of first the flow through nature of the pump and secondly because the plugs constitute at least one-half the total volume of the bellows. In addition, the opposed faces of the plugs prevent overtravel which would otherwise permanently damage the relatively fragile convolutions of the bellows 10.

Different fluids can be used without disassembling to clean out the system. Typically to change liquid a cleaning solution such as xylene is temporarily pumped through the bellows. Because of the internal porting, for example, 21*a* directed at the extreme convolutions, all the convolutions are effectively washed. Although the location of these internal ports as illustrated in the preferred embodiments has been found most effective in some applications a single port at an extreme convolution might be acceptable. However, the multiple ports do provide for greater flow capacity to prevent foaming or bubbling.

A stroke monitoring signal is generated without any chance of sparking by the combination of the lever 29 and the electro-optical sensor 34. This also has a multiple use as a manual priming means where the lever can be manually actuated.

Finally because of the small amount of static or dead space in the bellows a change of liquid from one type of a photoresist to another results in the loss of very little liquid. Thus it is apparent that the present invention has provided an improved flow through positive displacement pump.

What is claimed is:

1. A positive displacement flow through fluid pump comprising: a substantially cylindrical bellows having caps at both ends and both of said caps including a plug extending and displacing a substantial volume within said cylindrical bellows said plugs having juxtaposed portions for limiting said reciprocation of said bellows when such portions contact each other, said caps having inlet and outlet ports for the fluid to be pumped, both of said plugs including fluid flow channels perpendicular to the axis of said bellows connected to said inlet and outlet ports; and means for reciprocating said bellows for dispensing exact volumes of said fluid.

2. A pump as in claim 1 where said bellows include convolutions and said flow channels are directed toward said convolutions to provide a cleaning action.

3. A pump as in claim 2 where said flow channels are directed at the extreme convolutions at each end of said bellows.

4. A pump as in claim 2 where each of said plugs include a pair of flow channels one of the pair being displaced 90° from the other.

5. A positive displacement flow through fluid pump comprising: a substantially cylindrical bellows having caps at both ends and at least one cap including a plug extending and displacing a substantial volume within said cylindrical bellows, said caps having inlet and outlet ports for the fluid to be pumped; means for reciprocating said bellows for dispensing exact volumes of said fluid said reciprocating means including air cylinder means and lever means actuated by movement of said cylinder means for indicating its stroke completion; and electro-optical means for sensing said lever position for monitoring said stroke completion.

6. A pump as in claim 5 where said lever is manually operable for simulating a stroke completion to cause another stroke.

7. A pump as in claim 5 where said electro-optical means includes a light emitting diode switch.

* * * * *